US006699632B2

(12) United States Patent
Higuchi et al.

(10) Patent No.: US 6,699,632 B2
(45) Date of Patent: Mar. 2, 2004

(54) IMAGE FORMING TONER, AND IMAGE FORMING METHOD AND IMAGE FORMING APPARATUS USING THE TONER

(75) Inventors: Hiroto Higuchi, Shizuoka-ken (JP); Fumihiro Sasaki, Shizuoka-ken (JP); Yasuaki Iwamoto, Shizuoka-ken (JP); Hiroaki Matsuda, Shizuoka-ken (JP); Hiroshi Nakai, Kanagawa-ken (JP); Bing Shu, Shizuoka-ken (JP); Maiko Kondo, Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 86 days.

(21) Appl. No.: 09/996,585

(22) Filed: Nov. 30, 2001

(65) Prior Publication Data

US 2002/0102486 A1 Aug. 1, 2002

(30) Foreign Application Priority Data

Nov. 30, 2000 (JP) ..... 2000-365581

(51) Int. Cl.[7] ..... G03G 9/08; G03G 15/14; G03G 15/20

(52) U.S. Cl. ..... 430/110.3; 430/110.4; 430/124; 399/329

(58) Field of Search ..... 430/110.3, 110.4, 430/109.4, 124; 399/329, 335, 338, 88

(56) References Cited

U.S. PATENT DOCUMENTS

| | | | | |
|---|---|---|---|---|
| 4,758,489 | A | 7/1988 | Tomita et al. | |
| 4,762,763 | A | 8/1988 | Nomura et al. | |
| 4,908,290 | A | 3/1990 | Watanabe et al. | |
| 4,933,250 | A | 6/1990 | Nakayama et al. | |
| 4,950,573 | A | 8/1990 | Yamaguchi et al. | |
| 4,980,258 | A | 12/1990 | Aoki et al. | |
| 5,168,028 | A | 12/1992 | Nanya et al. | |
| 5,255,303 | A | 7/1993 | Tomita | |
| 5,288,577 | A | 2/1994 | Yamaguchi et al. | |
| 5,344,732 | A | 9/1994 | Chiba et al. | |
| 5,368,972 | A | 11/1994 | Yamashita et al. | |
| 5,380,616 | A | 1/1995 | Aoki et al. | |
| 5,403,690 | A | 4/1995 | Kuramoto et al. | |
| 5,429,901 | A | 7/1995 | Muto et al. | |
| 5,554,478 | A | 9/1996 | Kuramoto et al. | |
| 5,721,083 | A | 2/1998 | Masuda et al. | |
| 5,840,456 | A | 11/1998 | Tomita et al. | |
| 5,863,694 | A | 1/1999 | Sano et al. | |
| 5,882,832 | A | 3/1999 | Tosaka et al. | |
| 5,912,100 | A | 6/1999 | Aoki et al. | |
| 6,004,715 | A | 12/1999 | Suzuki et al. | |
| 6,010,814 | A | 1/2000 | Kotsugai et al. | |
| 6,074,794 | A | 6/2000 | Fushimi et al. | |
| 6,074,795 | A | 6/2000 | Watanabe et al. | |
| 6,103,441 | A | 8/2000 | Tomita et al. | |
| 6,180,298 | B1 | 1/2001 | Kuroda et al. | |
| 6,183,926 | B1 | 2/2001 | Kuroda et al. | |
| 6,228,550 | B1 * | 5/2001 | Matsuda et al. | 430/108 |
| 6,258,502 | B1 | 7/2001 | Nakamura et al. | |
| 6,303,257 | B1 | 10/2001 | Hasegawa et al. | |
| 6,303,258 | B1 | 10/2001 | Katoh et al. | |
| 6,335,137 | B1 * | 1/2002 | Suzuki et al. | 430/110.1 |
| 6,337,957 | B1 | 1/2002 | Tamaki et al. | |
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,403,275 | B1 | 6/2002 | Kuramoto et al. | |
| 6,406,826 | B1 | 6/2002 | Suzuki et al. | |
| 6,432,589 | B1 | 8/2002 | Uchinokura et al. | |
| 6,442,364 | B2 | 8/2002 | Kai et al. | |
| 6,505,014 | B2 | 1/2003 | Aoki et al. | |
| 6,507,718 | B2 | 1/2003 | Ohjimi et al. | |

FOREIGN PATENT DOCUMENTS

| | | |
|---|---|---|
| EP | 0 314 459 A2 | 5/1989 |
| EP | 0 314 459 A3 | 5/1989 |
| EP | 0 869 397 A2 | 10/1998 |
| EP | 0 869 399 A3 | 10/1998 |
| EP | 0 869 399 A2 | 10/1998 |
| JP | 7-295283 | 11/1995 |
| JP | 2763318 | 3/1998 |

* cited by examiner

*Primary Examiner*—John Goodrow
(74) *Attorney, Agent, or Firm*—Oblon, Spivak, McClelland, Maier & Neustadt, P.C.

(57) ABSTRACT

An image forming toner is provided, including at least:

a binder resin; a colorant; and a release agent, wherein a volume-average particle diameter of the toner measured by a Coulter counter is from 5 to 8 $\mu$m; the content of the toner having a volume-average particle diameter of not greater than 5 $\mu$m is 60 to 75% by number; and the content of the toner having a number-basis circle-equivalent particle diameter of from 0.6 to 3 $\mu$m measured by a flow-type particle image analyzer is not greater than 25%.

20 Claims, 5 Drawing Sheets

IMAGE FORMING TONER, AND IMAGE FORMING METHOD AND IMAGE FORMING APPARATUS USING THE TONER

BACKGROUND OF THE INVENTION

1. Field of the Invention

The present invention relates to an image forming toner as well as an image forming method and apparatus for developing a latent image in electrophotographic methods, electrostatic recording methods, electrostatic printing methods and the like methods.

2. Discussion of the Background

Among various electrophotographic method, a typical electrophotographic method is:

(1) forming an electrostatic latent image on a photoreceptor by various means using a photoconductive material;

(2) developing the latent image using a toner to form a toner image;

(3) optionally transferring the toner image on a paper and the like; and (4) fixing the toner image on the paper by heating, pressing or applying a solvent vapor to form a copy image.

As a method for developing an electrostatic latent image, there are two main methods. One is a liquid developing method using a developer in which various pigments and dyes are finely dispersed in an insulative organic liquid, and the other is a dry developing method such as a cascade method, a magnetic brush method and a powder cloud method and the like method using a toner in which a colorant such as carbon black is dispersed in a natural or synthetic resin. A dry developing method is widely used recently because of its easiness in handling.

As an fixing method in an electrophotographic method, a heat roller method is widely used because of its energy efficiency. In addition, recently, a heat energy given to a toner when fixing an image tends to become small for energy saving such as a low-temperature image fixation and a high-speed copy. Particularly, for saving energy, a reduction of total electric power consumption and $CO_2$ emission is strongly demanded. Therefore, shortening of a standby time (i.e., warmup time of an apparatus) between the time when an image forming apparatus is turned and the time when an image can be formed, and minimization of an electric power for heating the fixing portion beforehand (i.e., preheating the fixing portion) to make the fixing portion quickly have a temperature at which an image can be fixed are demanded.

In the DSM (Demand-Side Management) program of International Energy Agency (IEA) in 1999, there is a technology procurement project for the next-generation copiers, in which the specification requirements are announced. For a copier having not less than 30 cpm, the above-mentioned standby time should not be longer than 10 sec. and the electric power consumption for the standby should not be greater than 10 to 30 W (which is different according to the copy speed). Compared with the conventional copiers, a dramatic reduction of total electric power consumption and $CO_2$ emission is demanded. Particularly, in a high-speed image forming apparatus, a heating member is deprived of heat by a recording member, and an amount of heat for fixing an image is short. Therefore, further low-temperature fixability is necessary both for fixing devices and toners.

As an improvement of the fixing device, making the thickness of a roller which contacts the toner image supporting face not greater than 0.7 mm is attempted in order to increase the heat energy efficiency. The device significantly increases the energy efficiency and shortens the standby time. However, the mechanical strength of the roller becomes small, and the roller is deformed when a large load is applied thereto. Therefore, for a toner used for such an apparatus, low-temperature fixability which does not become a comparison with that of the conventional toner is required.

In addition, recently a need exists for high quality images, and sufficient image quality cannot be obtained by the conventional toners having a volume-average particle diameter of from 8 to 15 $\mu$m. Therefore, a toner having a smaller particle diameter is required in respect of image quality as well.

As a toner having a small particle diameter, Japanese Patent No. 2763318 discloses a toner having a volume-average particle diameter of from 4 to 10 $\mu$m, in which the quantity of the toner having a particle diameter of not greater than 5 $\mu$m is 17 to 60% by number. However, particularly in the above-mentioned image forming apparatus having small total electric consumption by shortening the standby time, the low-temperature fixability is not sufficient. In addition, even the toner having a particle-diameter distribution so as to satisfy the low-temperature fixability in an image forming apparatus having a low facing-pressure fixing device has the following drawbacks:

(1) the toner is melted and adheres to the developing device and to the photoreceptor because the amount of the release agent, etc. present on the surface of the toner particles increases because the toner has a small particle diameter and a large surface area; and (2) a non-image portion of the photoreceptor is developed with the toner. The reason is as follows. When cleaning the toner which is not transferred to the transfer member from the photoreceptor, the toner having such a small particle diameter (particularly a particle diameter of not greater than 3 $\mu$m) passes the cleaning portion and contaminate the charger in case of a contact charging method. Therefore, a bias cannot be applied to the photoreceptor and the electric potential of the non-image portion is not increased, resulting in formation of background development.

Therefore, simply a toner having the particle-diameter distribution disclosed in Japanese Laid-Open Patent Publication No. 7-295283 is not satisfactory in the durability, and a further improvement is necessary to make a toner satisfying both the low-temperature fixability and the durability.

SUMMARY OF THE INVENTION

Accordingly, an object of the present invention is to provide an image forming toner having sufficient low-temperature fixability without irregularity and deterioration of the image density of the resultant image due to the toner fixedly adhered on a developing sleeve of an image forming apparatus even when repeatedly used.

Another object of the present invention is to provide an image forming method and apparatus using the toner.

Briefly these objects and other objects of the present invention as hereinafter will become more readily apparent can be attained by an image forming toner characterized in that the toner includes at least a binder resin, a colorant and a release agent; a volume-average particle diameter of the toner measured by a Coulter counter is from 5 to 8 $\mu$m; the content of the toner having a volume-average particle diameter of not greater than 5 μm is 60 to 75% by number; and the content of the toner having a number-basis circle-equivalent particle diameter of from 0.6 to 3 μm measured by a flow-type particle image analyzer is not greater than 25%.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
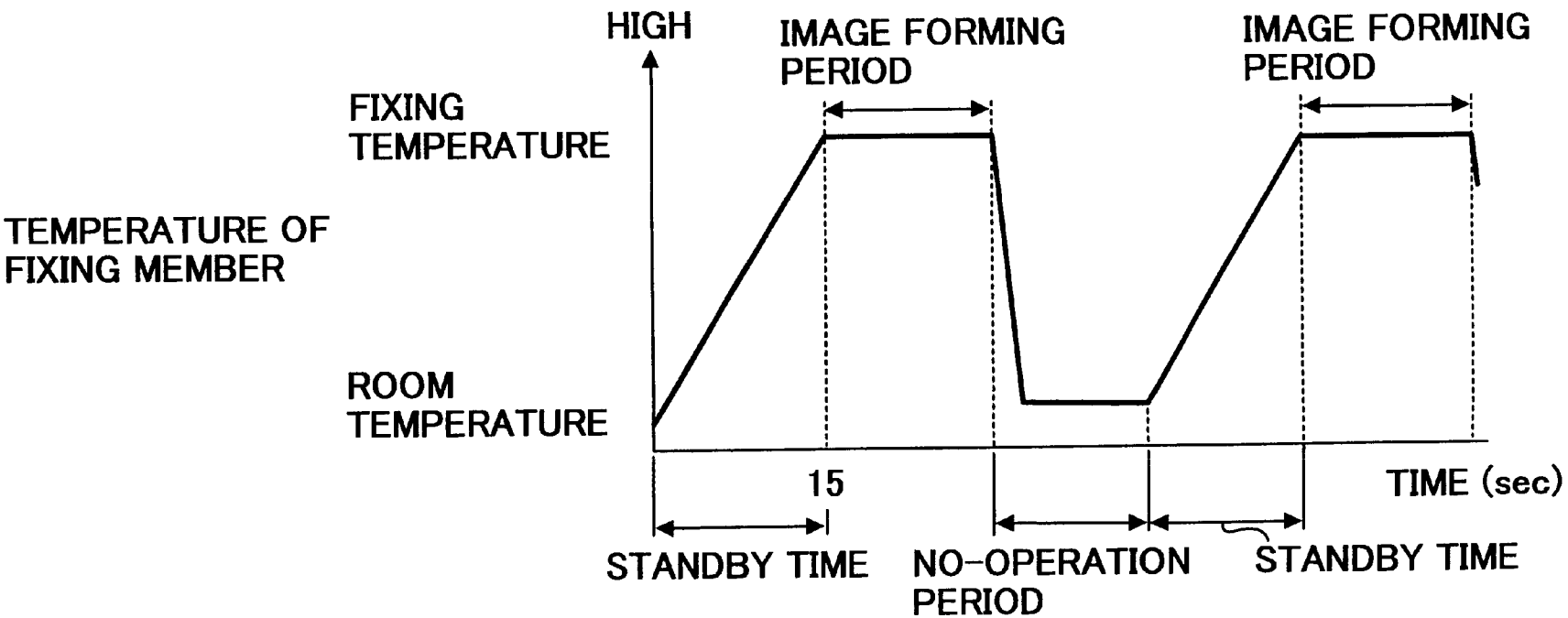
FIG. 1 is a graph showing an example of a relationship between the temperature of a fixing member and the time.

Generally, the present invention provides an image forming toner characterized in that the toner includes at least a binder resin, a colorant and a release agent; a volume-average particle diameter of the toner measured by a Coulter counter is from 5 to 8 μm; the content of the toner having a volume-average particle diameter of not greater than 5 μm is 60 to 75% by number; and the content of the toner having a number-basis circle-equivalent particle diameter of from 0.6 to 3 μm measured by a flow-type particle image analyzer_is not greater than 25%.

The toner having a volume-average particle diameter of from 5 to 8 μm and a particle-size distribution in which the content of the toner having a volume-average particle diameter of not greater than 5 μm is 60 to 75% by number can have sufficient low-temperature fixability and produce a high-quality image having good thin line reproducibility.

The toner having a volume-average particle diameter of greater than 8 μm has poor thin line reproducibility and fixability.

To the contrary, when the volume-average particle diameter is less than 5 μm, the toner is easily charged up because the specific surface area of the toner becomes large, and the image density of the resultant image deteriorates. In addition, the toner tends to enter a paper fiber, and the quantity of the toner which does not receive enough heat from a fixing member increases, resulting in deterioration of the low-temperature fixability.

When the content of the toner having a volume-average particle diameter of not greater than 5 μm is less than 60% by number, the thin line reproducibility and the fixability of the toner are poor as the toner having a volume-average particle diameter of greater than 8 μm. Not less than 60% by number of the toner having a volume-average particle diameter of not greater than 5 μm is a necessary condition to obtain sufficient agglutinability of the toner required to fix an image.

When the content of the toner having a volume-average particle diameter of not greater than 5 μm is greater than 75% by number, the toner is easily charged up because the specific surface area of the toner becomes large, and the image density of the resultant image and the low-temperature fixability of the toner deteriorate as the toner having a volume-average particle diameter of less than 5 μm. That is, in order to satisfy the low-temperature fixability of a toner, it is an essential condition that the volume-average particle diameter of the toner is from 5 to 8 μm and that the content of the toner having a volume-average particle diameter of not greater than 5 μm is 60 to 75% by number.

However, even when the toner having the above-mentioned particle-distribution is used, deterioration and irregularity of the image density of the resultant image due to the toner fixedly adhered to a developing sleeve of an image forming apparatus occur in repeated use.

This is because a Coulter counter (Model TA II) measures a particle diameter reading the change of the electric resistance using an electric signal, and cannot exactly measure the particle diameter of a particle having a particle diameter of not greater than 2 μm which are largely affected by an electric noise. On the other hand, flow-type particle image analyzer can measure the particle diameter of not greater than 2 μm because it measures a particle diameter by an image analysis. It is found that the toner having a number-basis circle-equivalent particle diameter of not greater than 3 μm (hereinafter referred to as an ultra-fine particulate toner) measured by the flow-type particle image analyzer has an influence on the above-mentioned drawbacks.

The ultra-fine particulate toner has a low mass, and the coulomb force to move to an image bearer (for developing an image ) is smaller than the van der Waal's force with a developing sleeve. Therefore, the toner is not developed on the image bearer and accumulate in a developer, and the toner adhered to the developing sleeve is finally melted and fixed thereon by a frictional heat and the like. Particularly in a non-image forming portion, a force (bias) to develop the toner on the developing sleeve works, and the toner is melted and fixed more remarkably on the developing sleeve. Since a proper bias to prevent the toner from being melted and fixed on the developing sleeve is not applied between the image bearer and the developing sleeve, deterioration and irregularity of the image density of the resultant image occur. That is, in order to provide a toner without deterioration and irregularity of the image density of the resultant image due to the toner melted and fixed on the developing sleeve, it is an essential condition that the content of the toner having a number-basis circle-equivalent particle diameter of from 0.6 to 3 μm measured by a flow-type particle image analyzer is not greater than 25%, preferably not greater than 15% by number.

In addition, if the toner has a peak at a molecular weight of at least between 1,000 and 10,000 and a half width of the peak of not longer than 15,000 when the molecular-weight distribution of tetrahydrofuran-soluble components of the toner is determined by Gel Permeation Chromatography (GPC), the toner quickly reacts with a heat and can be fixed at a low temperature. The half width of the peak is preferably not longer than 10,000.

In addition, when a binder resin included in a toner is a polyester resin, the toner has better low-temperature fixability. Besides the low-temperature fixability of a toner by decreasing the molecular weight (softening point)of the binder resin, it is considered that the hydrogen bonding between the molecules or in the molecules by a functional group included in the polyester resin such as a carboxyl group and a hydroxyl group can increase the inner agglutinability and low-temperature fixability of the toner.

Further when a magnetic material is included in a toner, a foggy image is not produced. It is considered that the ultra-fine particulate toner with a small charge causing the foggy image is kept in an image developer by a magnetic bias to prevent the toner scattering on an image bearer.

Figure 2:
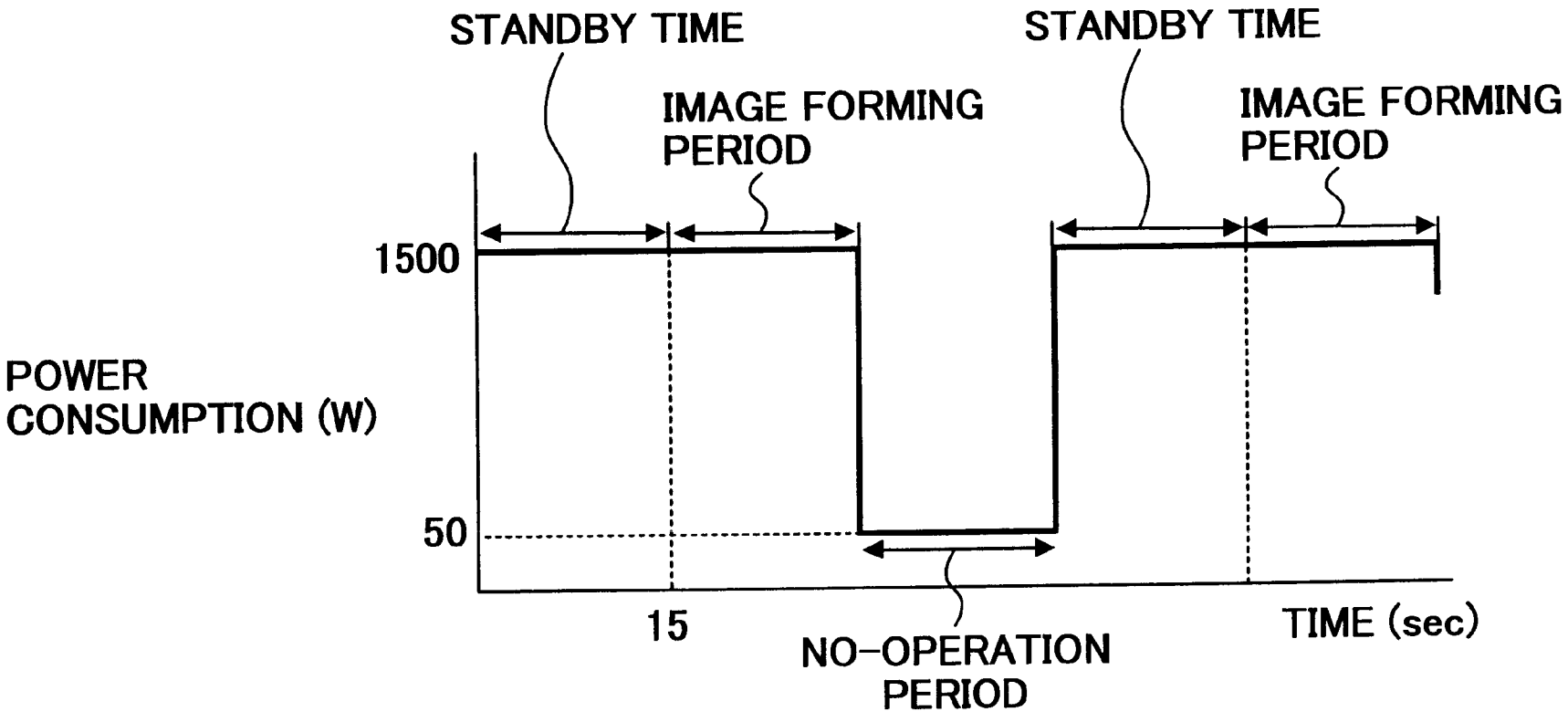
FIG. 2 is a graph showing a relationship between the total electric consumption of an image forming apparatus and the time in FIG. 1.

FIG. 1 shows an example of a relationship between the temperature of a fixing member and the time, and FIG. 2 shows a relationship between the total electric consumption of the image forming apparatus and the time in FIG. 1.

Typically, a fixing portion of an image forming apparatus has a lower temperature than the temperature capable of fixing an image when the apparatus does not work in order to minimize the electric consumption, and has the lowest temperature when the apparatus which is not preheated is turned on. A time (a standby time) to reach the temperature capable of fixing an image is necessary in order to produce a printout image, and the temperature of the fixing member develops as shown in FIG. 1. Electric power is not supplied to the fixing member after an image is printed out, and the temperature thereof gradually lowers (in a preheated status). The standby time and the printout are repeated when the printout is ordered again. FIG. 2 shows a progress of the electric consumption of the image forming apparatus controlled as shown in FIG. 1. The total electric consumption is an integration of the electric consumption and the time, and shortening the standby time is the most effective way for saving energy.

FIGS. 3 to 6 are outlined views illustrating the main portion of the fixing device of the present invention.

Figure 3:
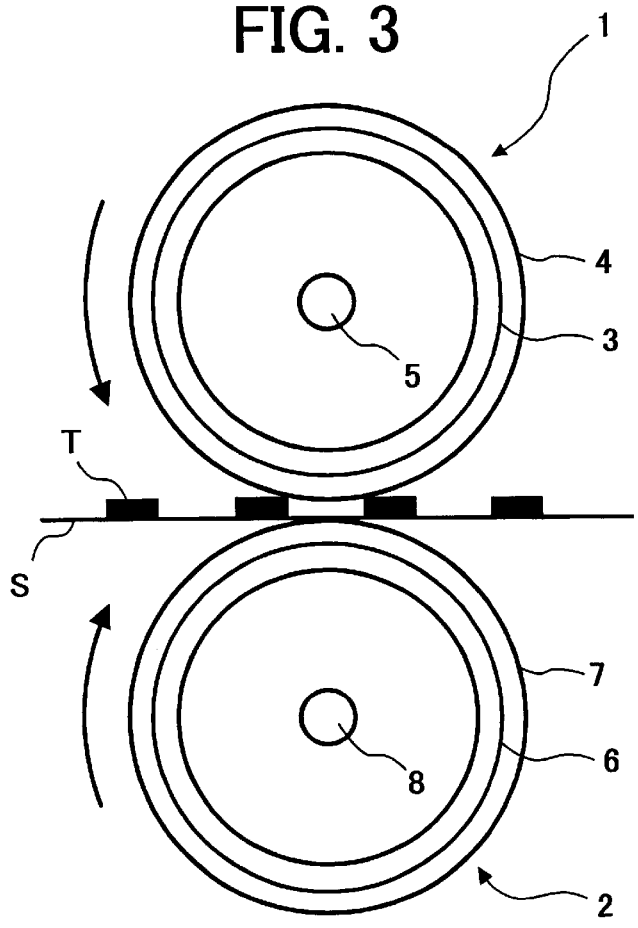
FIG. 3 is a schematic view illustrating the cross section of an embodiment of the fixing device of the present invention.

One of the fixing method in the image forming method of the present invention is to fix a toner image by passing a support bearing a toner image between two fixing members upon application of heat. Rollers, films, etc. are used as the member. FIG. 3 shows a fixing device using a roller. In FIG. 3, numeral 1 denotes a fixing roller and numeral 2 denotes a pressure roller respectively. The fixing roller is formed by a metallic cylinder 3 made of a heat conductive material such as aluminium, iron, stainless or brass coated with an offset-prevention layer 4 including RTV, silicone rubber, tetrafluoroethylene-perfluoroalkylvinylether (PFA), polytetrafluoroethylene (PTFE), etc. Inside the metallic cylinder 3, a heating lamp 5 is arranged. A metallic cylinder 6 of the pressure roller 2 is made of the same material as that of the metallic cylinder 3 of the fixing roller 1 in many cases, and the surface of the cylinder 6 is coated with an offset-prevention layer 7 including PFA, PTFE, etc. A heating lamp 8 is optionally arranged inside the pressure roller 2. The fixing roller 1 and the pressure roller 2 are pressed each other by springs (not shown) at both sides and rotate. A support S (a transfer sheet such as a paper) with a toner image T passes between the fixing roller 1 and the pressure roller 2 to fix an image on the support.

The fixing device of the present invention has a fixing roller including a metallic cylinder having a thickness of not greater than 0.7 mm, which improves the properties of rising the temperature of the fixing roller and can rise the temperature up to the predetermined temperature in quite a short time. The thickness of the metallic cylinder is preferably from 0.2 to 0.5 mm, though depending on the strength and the heat conductivity of the material used for the cylinder. A load between the fixing roller and the pressure roller (facing pressure) is preferably not greater than $1.5\times10^5$ Pa. The facing pressure is determined by dividing the load on the both sides of the rollers by the roller contact area. The roller contact area is determined as follows:

(1) a sheet, the surface of which considerably changes by a heat such as an OHP sheet is passed between the rollers heated up to the fixing temperature;

(2) the operation is stopped on the way and the sheet is put out after tens of seconds; and (3) the changed area of the sheet is determined as the roller contact area.

The facing pressure of the rollers is effectively used for fixing a toner image. However, in the above-mentioned fixing device, too much load cannot be applied to the roller including the metallic cylinder having the thickness of not greater than 0.7 mm because the roller is deformed by the load. Therefore, the load is not grater than $1.5\times10^5$ Pa, and preferably from 0.4 to $1.0\times10^5$ Pa.

The above-mentioned device has both sufficient low-temperature fixability and durability even in a short standby time. The reason why the above-mentioned toner has sufficient fixability is the agglutinability of the toner besides an embedding (anchor) effect of the toner on a paper in the device of the present invention having the quite small facing pressure. Therefore, it is found that a toner having a small particle diameter has an advantage in the present invention.

Figure 4:
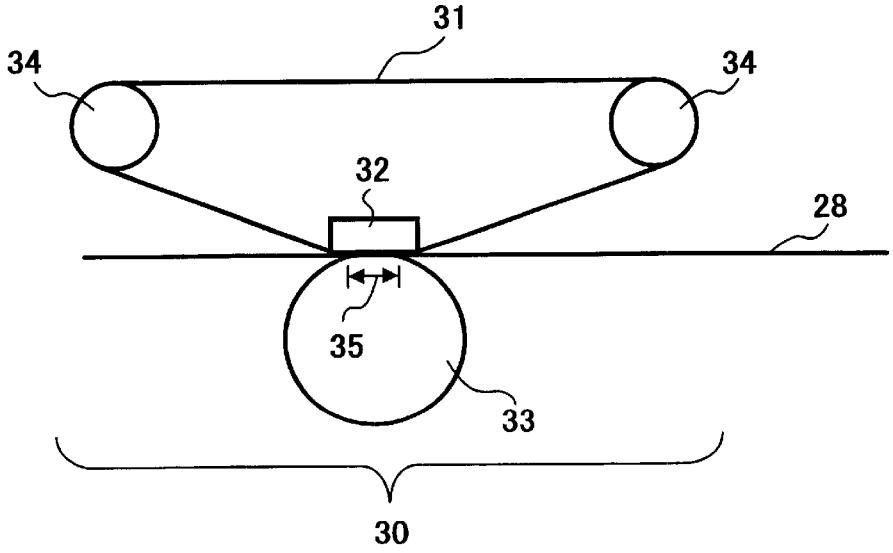
FIG. 4 is a schematic view illustrating the structure of a fixing device having one heating member.

FIG. 4 is an embodiment of a fixing portion having one heater. The heater is a belt-shaped heater 31, and is pressed against a fixed heating element 32 by a pressure member 33. In addition, a tension is applied to the heater 31 by a rotatable tensioner 34. A recording medium 28 is transferred by a transferer (not shown) to a contact heating area 35 formed by the heater 31 and the pressure member 33 in the fixing portion 30, and then an image is fixed by a heat pressing. At this point, a toner image is formed on the side of the recording medium 28 facing the heater 31.

Figure 5:
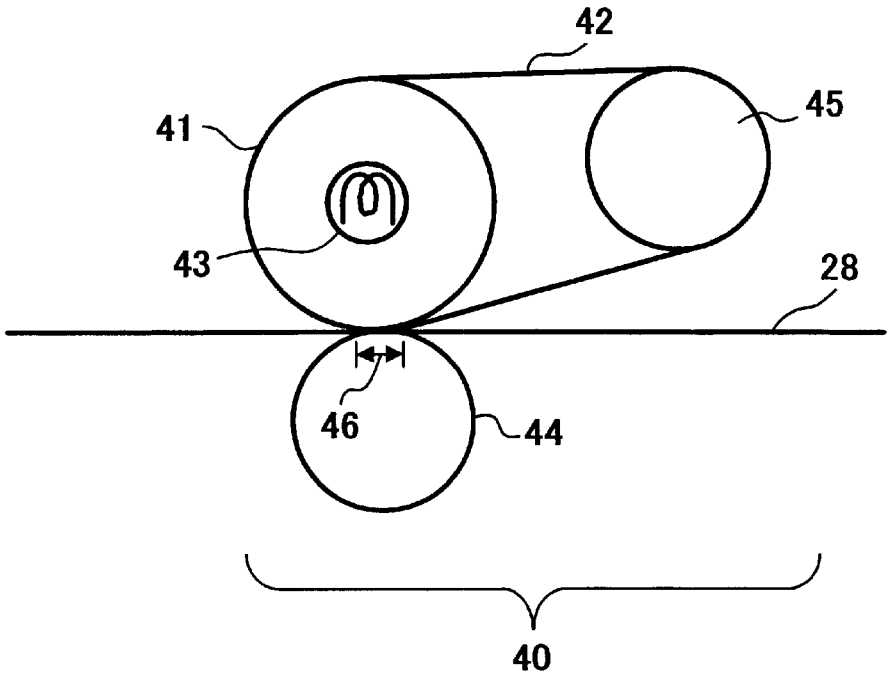
FIG. 5 is a schematic view illustrating a structure of a fixing device having two heating members.

FIG. 5 is an embodiment of a fixing portion having two heaters, in which the contact heating area is mainly formed by a pressure of the pressure member.

The heater is formed by a hollow roller-shaped heater 41 and a belt-shaped heater 42, and a heating element 43 is arranged inside the heater 41. The heater 42 is pressed against the heater 41 by a pressure member 44. In addition, a tension is applied to the heater 42 by a rotatable roller-shaped tensioner 45. A recording medium 28 is transferred by a transferer (not shown) to a contact heating area 46 formed by the heater 42 and the pressure member 44 in the fixing portion 40, and then an image is fixed by a heat pressing. At this point, a toner image is formed on the side of the recording medium 28 facing the heater 42.

Figure 6:
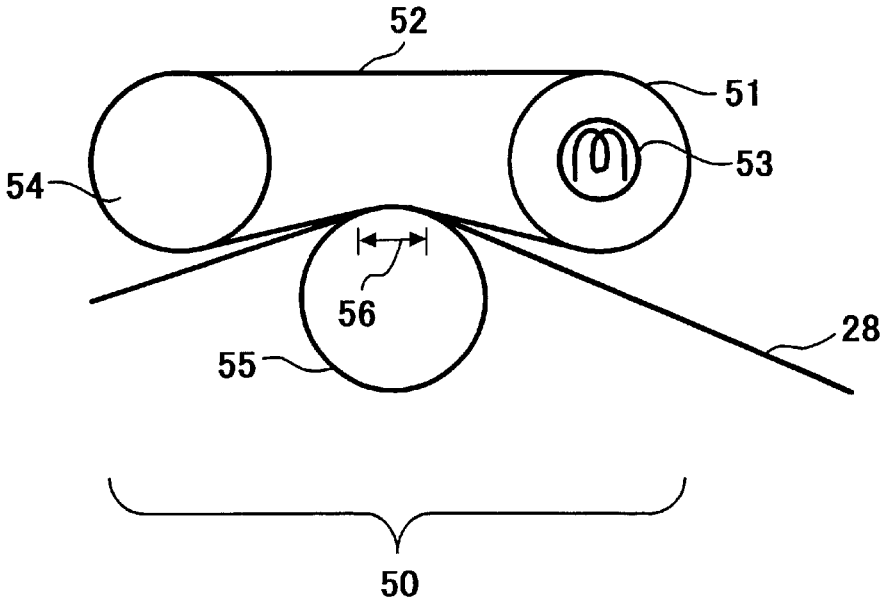
FIG. 6 is a schematic view illustrating a structure of a fixing device having two belt-shaped heating members, in which_a fixing nip is formed by the tensile force of the heating members.

FIG. 6 is an embodiment of a fixing portion having two heaters, in which the contact heating area is formed by a tension of a belt-shaped heater.

The heater is formed by a hollow roller-shaped heater 51 and a belt-shaped heater 52, and a heating element 53 is arranged inside the heater 51. A tension is applied to the heater 52 by a rotatable roller-shaped tensioner 54, and the heater 52 is pressed by a pressure member 55 to form a contact heating area 56. A recording medium 28 is transferred by a transferer (not shown) to the contact heating area 56 formed by the heater 52 and the pressure member 55 in the fixing portion 50, and then an image is fixed by a heat pressing. At this point, a toner image is formed on the side of the recording medium 28 facing the heater 52.

In addition, a release-oil applicator may be arranged in these fixing devices for the purpose of preventing or assisting to prevent a hot offset.

Figure 7:
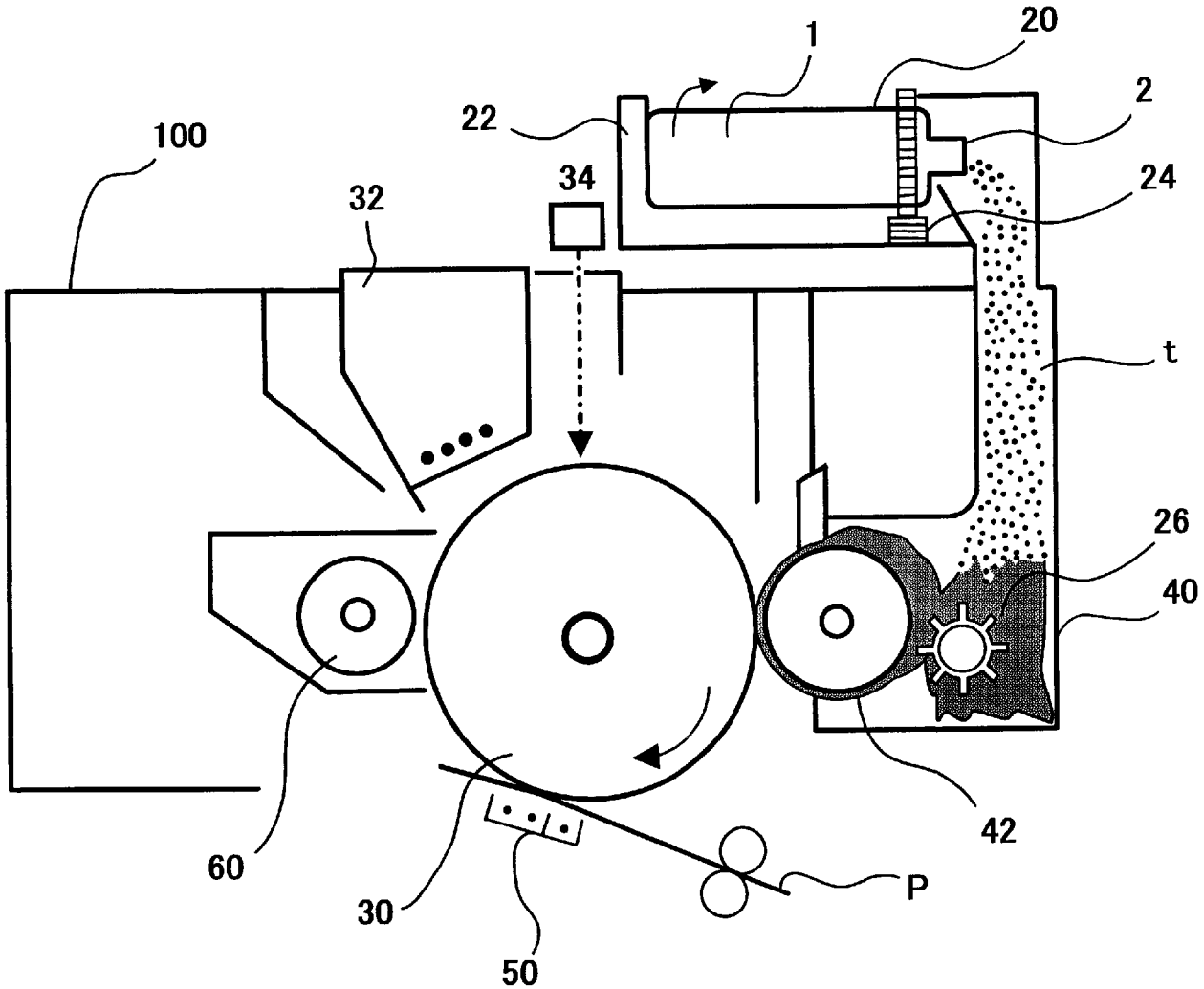
FIG. 7 is a schematic view illustrating a main part of an embodiment of the image forming apparatus 100 useful for the image forming method of the present invention.

As shown in FIG. 7, a toner container 1 is horizontally and detachably set in a toner supplying device 20 of an image forming apparatus 100. The toner supplying device 20 includes a toner container supporting member 22 which supports a toner container 1 such that the opening 2 of the toner container 1 leads to a toner supplying portion 26 in a developing device 40 of the image forming apparatus 100. In addition, the toner supplying device 20 includes a toner container rotating member 24 which rotates the toner container 1 such that the container 1 rotates around the center axis thereof. A toner t is discharged from the opening 2 toward the toner supplying portion 26.

As shown in FIG. 7, a layer of a developer including the toner t is formed on a developing roller 42. On the other hand, a photoreceptor 30 (i.e., an image bearing member) is charged with a charger 32. Then an imagewise light irradiating device 34 irradiates the charged photoreceptor with light to form an electrostatic latent image on the photoreceptor 30. The latent image is developed with the developer layer to form a toner image on the photoreceptor 30. The toner image is transferred to a receiving paper P using a transfer device 50. Then the photoreceptor 30 is cleaned with a cleaner 60. The toner image on the receiving paper P is fixed by a belt fixing device (not shown). Thus, a document is produced.

As mentioned above, the developer may be a one component developer (i.e., a toner) or a two-component developer which includes a toner and a carrier. In a developing method using a two-component developer, the container 1 may includes only a toner or a two-component developer.

The present invention provides an image forming apparatus, in which a time between the time when the apparatus is turned on and the time when the apparatus is ready to produce an image (a standby time) is not longer than 15, preferably 10 seconds.

In addition, the apparatus has a total electric consumption of not greater than 1.5 KW when working, and not greater than 30W when not working. Particularly, when the toner of the present invention is used in an image forming apparatus which can produce not less than 30 sheets of A4 size image a minute, the apparatus can have enough low-temperature fixability and reduce the total electric consumption as well.

In addition, it is further preferable that an image forming method includes at least a cleaning process, in which an elastic rubber blade contacting the photoreceptor in the direction thereof cleans the residual toner thereon after a toner image developed thereon is transferred on a recording medium because a paper dust and a filming toner can be effectively removed.

Specific examples of the binder resin for use in the toner of the present invention include styrene and its substitute polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methylacrylate copolymers, styrene-ethylacrylate copolymers, styrene-butylacrylate copolymers, styrene-octylacrylate copolymers, styrene-ethylmethacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-ester maleate copolymers; polymethylmethacrylate, poly butyl methacrylate, poly vinyl chloride, poly vinyl acetate, polyethylene, polypropylene, polyester, epoxy resins, epoxy polyol resins, polyurethane, polyamide, poly vinyl butyral, polyacrylate resins, rosin, modified rosin, terpene resins, aliphatic or aliphatic hydrocarbon resins, aromatic petroleum resins, chlorinated paraffin and paraffin waxes. These can be used alone or in combination.

All known release agents can be used as the release agent of the present invention. Particularly, free-fatty-acid type carnauba waxes, montan waxes and oxidized rice waxes can be used alone or in combination. It is preferable that the carnauba wax has a microcrystal and an acid value of not greater than 5, and that the particle diameter is not greater than 1 μm when dispersed in a toner binder. The montan wax is typically a wax refined from a mineral substance, and preferably has a microcrystal as the carnauba wax does and an acid value of from 5 to 14. The oxidized rice wax is a rice-bran wax oxidized in the air, and preferably has an acid value of from 10 to 30. Any other known release agents such as solid-silicone varnish, higher-fatty-acid higher alcohol, montan ester waxes, low- molecular-weight polypropylene waxes and the like can be used in combination. The content of the release agent is from 1 to 20 parts by weight, preferably from 3 to 10 parts by weight per 100 parts by weight of the resin included in the toner. The volume-average particle diameter of the release agent before dispersed in the toner binder is preferably from 10 to 800 μm. When the particle diameter is less than 10 μm, the dispersion diameter in the toner binder is small and the releasability is not sufficient, resulting in occurrence of offset. When the particle diameter is greater than 800 μm, the dispersion diameter in the toner binder is large and the precipitaion of the release agent on the surface of the toner becomes large, resulting in occurrence of the fluidity deterioration and adherence to a developing device of the toner. A laser diffraction/scattering particle size distribution instrument model No. LA-920 from Horiba, Ltd. is used to measure the particle diameter.

Specific examples of the magnetic material for use in the present invention include iron oxide such as magnetite, hematite and ferrite; metals such as iron, cobalt and nickel; or metal alloys such as the metals with aluminium, cobalt, copper, lead, magnesium, tin, zinc, stibium, beryllium, bismuth, cadmium, calcium, manganese, selenium, titanium, tungsten and vanadium; and the mixture of these materials.

The magnetic material has an average particle diameter of from 0.1 to 1 μm, preferably from 0.2 to 0.4 μm. The content of the magnetic material included in the toner is preferably from 20 to 200 parts by weight, more preferably from 30 to 100 parts by weight per 100 parts by weight of the resin included in the toner.

As the colorant for use in the present invention, any known dyes and pigments such as carbon black, lamp black, iron black, aniline blue, Phthalocyanine Blue, Phthalocyanine Green, Hansa Yellow G, Rhodamine 6C Lake, chalco Oil Blue, chrome yellow, quinacridone, Benzidine Yellow, Rose Bengal and triallylmethane dyes can be used alone or in combination.

In addition, the dyes and pigments can be used as a black toner as well as a full-color toner. The content of the colorant included in the toner is from 1 to 30% by weight, preferably from 3 to 20% by weight per 100% of the resin included in the toner.

The toner of the present invention may optionally include a charge controller, a fluidity improver, etc.

As the charge controller, any known charge controllers such as nigrosin dyes, metal complex dyes and quaternary ammonium salt can be used alone or in combination. The negative charge controller includes metallic salts of mono azo dyes, salicylic acid, metal complex of dicarboxylic acid, etc. The content of the charge controller is from 0.1 to 10 parts by weight, preferably from 1 to 5 parts by weight per 100 parts by weight of the resin included in the toner.

As the fluidity improver, any known fluidity improvers such as silicon oxide, titanium oxide, silicon carbide, aluminium oxide, barium titanate, etc. can be used alone or in combination. The content of the fluidity improver is from 0.1 to 5 parts by weight, preferably from 0.5 to 2 parts by weight per 100 parts by weight of the toner.

As a carrier for use in a two-component developer including the toner of the present invention, all known carriers such as magnetic powders like iron powder, ferrite powder, nickel powder and the like powders; glass beads and the like; and these materials coated with a resin, etc. can be used.

Specific examples of the resin powders which can be coated on the carrier of the present invention include styrene-acryl copolymers, silicone resins, maleic acid resins, fluorocarbon resins, polyester resins, epoxy resins, etc. It is preferable to use a styrene-acryl copolymer having styrene of from 30 to 90% by weight. When the styrene is less than 30%, the developing properties deteriorate. When the styrene is greater than 90% by weight, the coated layer becomes hard and easy to peel off, resulting in short-life of the carrier.

The coating on the carrier of the present invention may include an adhesion imparting agent, a hardener, a lubricant, a conductive material, a charge controlling agent, etc. besides the above-mentioned resins.

An outline of the Coulter counter and the flow-type particle image analyzer used to measure the particle distribution in the present invention will be explained. An interface from Nikkaki-Bios Co., Ltd. producing a number and volume distribution, and a personal computer model No. PC9801 from NEC Corporation are connected with the Coulter counter model No. TA II from Coulter Electronics, Inc. in order to measure the volume-average particle diameter and the % by number of the particles having a particle diameter of not greater than 5 $\mu$m. A battery electrolyte is an aqueos solution including 1% of NaCl using a primary natrium chloride. The measurement is performed as follows:

(1) from 0.1 to 5 ml of a surfactant as a dispersant, preferably alkylbenzenesulfonic salt and from 1 to 10 mg of a toner sample are included in from 50 to 100 ml of the above-mentioned battery electrolyte;

(2) the mixture is dispersed by an ultrasonic disperser for a minute;

(3) the above-mentioned dispersed sample mixture is included in the battery electrolyte of from 100 to 200 ml in another beaker until the sample mixture has a predetermined concentration;

(4) the particle distribution of 30,000 particles having a particle diameter of from 2 to 40 $\mu$m on a number basis is measured by the above-mentioned Coulter counter model No. TA II using an aperture of 100 $\mu$m; and (5) the volume and the number distribution of the particles are calculated to determine the volume-average particle diameter (D4: a medium value of each channel is considered to be the representative of the channel) on a weight basis by the volume distribution.

The circle-equivalent particle diameter and the number distribution can be measured by the flow-type particle image analyzer model No. FPIA-2100 from SYSMEX Co., Ltd. The outline of the apparatus and the measurement is disclosed in Japanese Laid-Open Publication No. 8-136439. The measurement is performed as follows:

(1) from 0.1 to 5 ml of a surfactant as a dispersant, preferably alkylbenzenesulfonic salt and from 1 to 10 mg of a toner sample are included in from 50 to 100 ml of the above-mentioned battery electrolyte passed through a filter having an aperture of 0.45 $\mu$m;

(2) the mixture is dispersed by an ultrasonic disperser for a minute to form a dispersed sample mixture having a particle concentration of from 5,000 to 15,000 particles/$\mu$l; and (3) the particle number is determined:

a. the area of the two-dimensional image of a particle photographed by a CCD camera is determined;

b. the diameter of a circle having the same area as the area of the particle is considered to be the diameter of the particle;

c. this particle diameter is referred to as the circle-equivalent particle diameter;

d. the number of the particles having a particle diameter of not less than 0.6 $\mu$m in the circle-equivalent particle diameter is determined; and e. in this case, particles having a circle-equivalent particle diameter of not less than 0.6 $\mu$m is considered to be effective, considering the pixel accuracy of the CCD.

The GPC of the present invention is measured as follows:

(1) a column is stabilized in a heat chamber having a temperature of 40° C.;

(2) tetrahydrofuran (THF) is put into the column at a speed of 1 ml/min. as a solvent;

(3) from 50 to 200 $\mu$l of the THF liquid-solution sample including the toner having a concentration of from 0.05 to 0.6% by weight is put into the column; and (4) the molecular weight distribution of the sample is determined by using a calibration curve which is previously prepared using several polystyrene standard samples having a single distribution peak, and which shows the relationship between a count number and the molecular weight.

As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 kinds of the standard polystyrene samples. In addition, an RI (refraction index) detector is used as the detector.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, a manufacturing example of a carrier including a silicone resin in the coated layer for use in the present examples will be explained. This can be manufactured by known methods.

Carrier Manufacturing Example 1

The following materials were mixed and dispersed by a homomixer for 30 min. to prepare a liquid for coating a carrier.

| | |
|---|---|
| Liquid solution of a silicone resin (tradenamed as SR2411 manufactured by Toray Silicone Industries, Inc.) | 100 |
| Carbon black (tradenamed as #44 manufactured by Mitsubishi Kasei Corporation) | 4 |
| Toluene | 100 |

The coating liquid was coated on 1,000 parts by weight of a spherical ferrite having an average particle diameter of 80 μm by a fluidized-bed coater to prepare a carrier A.

Example 1

The following materials were mixed and stirred in a Henschel mixer to prepare a mixture.

| | |
|---|---|
| Styrenemethylacrylate (The weight average molecular weight is 440,000 and the melting point is 127° C.) | 100 |
| Carnauba wax (The melting point is 82° C. and the volume-average particle diameter is 490 μm.) | 3 |
| Carbon black (tradenamed as #44 manufactured by Mitsubishi Kasei Corporation) | |
| A metal-containing azo compound | |

The mixture was heated and melted by a roll mill at from 130 to 140° C. for 30 min., and cooled at a room temperature to prepare a mixture A. The mixture A was crushed by a hammer mill to have a particle diameter of from 200 to 400 μm. The crushed mixture was pulverized and classified by a pulverizing classifier model No. IDS-2 manufactured by Nippon Pneumatic Mfg. Co., Ltd., which has a pulverizer pulverizing the crushed mixture by crashing the mixture against the crash board by a jet stream as well as a wind classifier classifying the pulverized mixture by centrifugation by forming a rotating airflow in the classifying room. Thus, a classified toner is prepared. The particle-diameter distribution is measured by the Coulter counter and the flow-type particle image analyzer. The desired particle-diameter distribution can be provided by changing such as the amount of the crushed mixture supplied to the pulverizer; the air pressure and the airflow for pulverizing; the shape of the crash member for crashing; the air inflow location and direction in the classifier; and the pressure of the exhaust blower.

1.0 parts by weight of an additive (tradenamed as R972 manufactured by Nippon Aerosil Co.) was mixed and stirred with 100 parts by weight of the classified toner by a Henschel mixer, and the particles having a large particle diameter were removed by a mesh to prepare a toner 1 having a particle-diameter distribution described in Table 1. The molecular-weight distribution of the toner 1 had a main peak at 4,000 and the half width of the peak was 35,000. 3 parts by weight of the toner 1 and 97 parts by weight of the carrier A were mixed by a ball mill to prepare a developer 1.

Example 2

The procedures for preparation of the toner 1 and the developer 1 were repeated except for controlling the conditions of the pulverization and classification to prepare a toner 2 having a particle-diameter distribution described in Table 1 and a developer 2.

Example 3

The procedures for preparation of the toner 1 and the developer 1 were repeated except for using the following materials to prepare a toner 3 having a particle-diameter distribution described in Table 1 and a developer 3.

| | |
|---|---|
| Polyester resin (The weight average molecular weight is 7,000, the melting point is 110° C. and the acid value is 25 mg KOH/g) | 60 |
| Polyester resin (The weight average molecular weight is 80,000, the melting point is 143° C. and the acid value is 20 mg KOH/g) | 40 |
| Carnauba wax (The melting point is 82° C. and the volume-average particle diameter is 490 μm.) | 3 |
| Carbon black (tradenamed as #44 manufactured by Mitsubishi Kasei Corporation) | |
| A metal-containing azo compound | |

The molecular-weight distribution of the toner 3 had a main peak at 4,000 and the half width of the peak was 12,000.

Example 4

The procedures for preparation of the toner 3 and the developer 3 were repeated except for additionally including 50 parts by weight of fine particles of magnetite having a particle diameter of 0.25 μm into the materials to prepare a toner 4 having a particle-diameter distribution described in Table 1 and a developer 4.

The molecular-weight distribution of the toner 4 had a main peak at 4,000 and the half width of the peak was 12,000.

Comparative Example 1

The procedures for preparation of the toner 1 and the developer 1 were repeated except for controlling the conditions of the pulverization and classification to prepare a toner 5 having a particle-diameter distribution described in Table 1 and a developer 5.

Comparative Example 2

The procedures for preparation of the toner 1 and the developer 1 were repeated except for controlling the conditions of the pulverization and classification to prepare a toner 6 having a particle-diameter distribution described in Table 1 and a developer 6.

Comparative Example 3

The procedures for preparation of the toner 1 and the developer 1 were repeated except for controlling the conditions of the pulverization and classification to prepare a toner 7 having a particle-diameter distribution described in Table 1 and a developer 7.

TABLE 1

| | | X | Y | Z |
|---|---|---|---|---|
| Example 1 | Toner 1 | 6.78 | 62.6 | 23 |
| Example 2 | Toner 2 | 6.85 | 60.2 | 14.8 |
| Example 3 | Toner 3 | 6.79 | 63.5 | 20.5 |
| Example 4 | Toner 4 | 6.78 | 62.6 | 23 |
| Comparative example 1 | Toner 5 | 6.82 | 55.5 | 13.8 |
| Comparative example 2 | Toner 6 | 6.62 | 64.8 | 33.9 |
| Comparative example 3 | Toner 7 | 4.4 | 74.5 | 23.2 |

X: Volume-average particle diameter (μm)
Y: The content of the particles having a particle diameter of not greater than 5 μm (% by number)
Z: The content of the particles having a circle-equivalent particle diameter of from 0.6 to 3 μm (% by number)

Each developer was evaluated by the following methods.

Low-temperature Fixability

A copy test was performed using the following apparatus and copy paper.

1. A copier model No. MF-4550 manufactured by Ricoh Company, Ltd. having a teflon roller as a fixing roller, in which the fixing portion was modified such that the fixing roller made of Fe has a thickness of 0.4 mm, a liner velocity of 230 mm/sec. and a facing pressure of $0.9\times10^5$.
2. A copy paper type A4 <135> manufactured by NBS Ricoh Co., Ltd.

The fixing temperature was changed for each developer to produce a copy image having an image density of 0.8 which was measured by a Macbeth densitometer. Each copy image was scraped by a clock meter having a cloth of cotton No. 3 of JIS-L-0803 standard for 10 times. Then, the density of the toner transferred to the cloth was measured by the Macbeth densitometer. The temperature to achieve the density of not greater than 0.4 was determined as the minimum fixing temperature. The minimum fixing temperature of the current toner (Imagio toner type 12 having a volume-average particle diameter of 9.60 μm and 15% by number of the particles having a particle diameter of not greater than 5 μm) was 190° C.

Good

◎: less than 160° C.

○: 160 to 170° C.

□: 170 to 180° C.

Δ: 180 to 190° C.

X: greater than 190° C.

Poor

Image Density, Irregularity of Image Density, Thin Line Reproducibility and Foggy Image Using the developers 1 to 7, each 100,000 copies of a laterally-set A4 chart (image pattern A) in which a black and a white solid image are repeatedly printed at an interval of 1 cm were produced by the copier model No. MF-4550 manufactured by Ricoh Company, Ltd. such that the longitudinal direction of the black and white solid images is perpendicular to the direction of the rotating direction of the developing sleeve. The copier had a cleaning blade and a charging roller which contact the photoreceptor. Then, an image produced afterwards by each developer was evaluated by the following methods.

(Image Density)

A black solid image having an area of 1 cm×1 cm was produced in a lateral A4 sheet by each developer. The density of the center and the four corners of each image was measured by the Macbeth densitometer to determine the average density of the five places.

Good

◎: not less than 1.4

○: 1.3 to 1.4

□: 1.2 to 1.3

Δ: 1.1 to 1.2

X: not greater than 1.1

Poor (Irregularity of Image Density)

An A3 copy of a repeated black and white image (halftone) was produced at 2 dots×2 dots (600 dpi) by each developer. Each image was graded into the following 5 grades. As for a poor image, a toner image was developed on the sleeve in a reverse pattern, and irregularity of the image density appeared particularly when a halftone image was produced.

Good

◎: Quite good

○: Good

□: Normal

Δ: Poor

X: Quite poor

Poor (Thin Line Reproducibility)

A dot line image was produced by each developer, and each image was graded into the following 5 grades.

Good

◎: Quite good

○: Good

□: Normal

Δ: Poor

X: Quite poor

Poor (Foggy Image)

The toner density of the non-image portion of each initial image and the image after 100,000 copies were produced was graded into the following 5 grades.

Good

◎: Quite good

○: Good

□: Normal

Δ: Poor

X: Quite poor

Poor

The results of the evaluation are shown in Table 2.

TABLE 2

| | | LT | ID | IR | TL | FI |
|---|---|---|---|---|---|---|
| Example 1 | Developer 1 | ○ | ○ | ○ | ○ | ○ |
| Example 2 | Developer 2 | ○ | ○ | ◎ | ○ | ○ |
| Example 3 | Developer 3 | ◎ | ○ | ○ | ○ | ○ |
| Example 4 | Developer 4 | ◎ | ○ | ○ | ○ | ◎ |
| Comparative example 1 | Developer 5 | □ | ○ | ○ | □ | ○ |

TABLE 2-continued

| | | LT | ID | IR | TL | FI |
|---|---|---|---|---|---|---|
| Comparative example 2 | Developer 6 | ○ | Δ | X | ○ | ○ |
| Comparative example 3 | Developer 7 | □ | Δ | Δ | ○ | ○ |

LT: Low-temperature fixability
ID: image density
IR: Irregularity of image density
TL: Thin line reproducibility
FI: Foggy image This document claims priority and contains subject matter related to Japanese Patent Application No. 2000-365581 filed on Nov. 30, 2000 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming toner having low temperature fixability and thin line reproducibility comprising:

a binder resin;

a colorant; and a release agent, wherein the toner has a volume-average particle diameter, as measured by a Coulter counter, of from 5 to 8 μm; the toner has a content of particles having a volume-average particle diameter of not greater than 5 μm of from 60 to 75% by number; and the toner has a content of particles having a number-basis circle-equivalent particle diameter of from 0.6 to 3 μm, as measured by a flow-type particle image analyzer, or not greater than 25%.

2. The image forming toner of claim 1, wherein the content of the toner having a number-basis circle-equivalent particle diameter of from 0.6 to 3 μm is not greater than 15%.

3. The image forming toner of claim 1, wherein the toner has a peak at a molecular weight of at least between 1,000 and 10,000 and a half width of the peak of not longer than 15,000, as determined by Gel Permeation Chromatography (GPC) measurement of molecular-weight distribution of tetrahydrofuran-soluble components of the toner.

4. The image forming toner of claim 1, wherein the binder resin is a polyester resin.

5. The image forming toner of claim 1, wherein the volume-average particle diameter of the release agent before dispersal in the binder resin is from 10 to 800 μm.

6. The image forming toner of claim 1, further comprising a magnetic material.

7. An image forming apparatus comprising:

an image bearing;

an image developer comprising a developer, wherein the developer comprises a carrier and a toner wherein the toner is the image forming toner of claim 1;

an image transferer; and a fixer, wherein the apparatus has a total electric consumption of not greater than 1.5 KW when working, and not greater than 30 W when not working, and wherein the apparatus is configured to provide a time delay between turning on the apparatus and forming an image of not longer than 15 seconds.

8. The image forming apparatus of claim 7, wherein the time delay is not longer than 10 seconds.

9. The image forming apparatus of claim 7, which can produce not less than 30 sheets of A4 size image a minute.

10. An image forming method comprising:

transferring a toner image on a face of a transfer sheet; and fixing the toner image upon application of heat on the transfer sheet by passing the transfer sheet between two fixing members, wherein the fixing member contacting the face of the transfer sheet bearing the toner image has a thickness of not greater than 0.7 mm, and a facing pressure applied to the two fixing members is not greater than $1.5\times10^5$ Pa (a load on the fixing member/contact area), and wherein the toner image is formed using the image forming toner of claim 1.

11. An image forming method comprising:

transferring a toner image on a transfer sheet;

heating a heating member by a fixed heating element; and pressing the transfer sheet bearing the toner image against the heating member to fix the image on the transfer sheet, wherein the heating member has a shape of a belt either with an edge or without an edge, and wherein the toner image is formed using the image forming toner of claim 1.

12. An image forming method comprising:

charging an image bearer by a charger contacting the image bearer;

transferring a toner image developed on the image bearer to a transfer sheet; and cleaning residual toner from the image bearer by an elastic rubber blade contacting the image bearer, wherein the toner image is formed using the image forming toner of claim 1.

13. An image forming apparatus comprising:

an image transferer for transferring a toner image on a face of a transfer sheet;

a fixer comprising two fixing members for fixing the toner image on the transfer sheet upon application of heat by passing the transfer sheet therebetween, wherein the thickness of the fixing member contacting the face of the transfer sheet bearing the toner image is not greater than 0.7 mm, and a facing pressure applied to the two fixing members is not greater than $1.5\times10^5$ Pa (a load on the fixing member/contact area), and wherein the toner image is formed using the image forming toner of claim 1.

14. An image forming apparatus comprising:

an image transferer for transferring a toner image on a transfer sheet;

a fixer comprising a heating element for heating a heating member; and a pressure member for pressing the transfer sheet against the heating member to fix the image on the transfer sheet, wherein the heating member has a shape of a belt either with an edge or without an edge, and wherein the toner image is formed using the image forming toner of claim 1.

15. An image forming apparatus comprising:

a charger for charging an image bearer contacting the image bearer;

a transferer for transferring a toner image developed on the image bearer to a transfer sheet; and a cleaner for cleaning the residual toner on the image bearer with an elastic rubber blade contacting the image bearer, wherein the toner image is formed using the image forming toner of claim 1.

16. A two-component image forming developer comprising the image forming toner of claim 1 and a carrier.

17. A toner container containing the image forming toner of claim 1.

18. A container containing the two-component developer of claim 16.

19. An image forming apparatus comprising the toner container of claim 17.

20. An image forming apparatus comprising the container of claim 18.

* * * * *